US005095675A

United States Patent [19]

Audia

[11] Patent Number: 5,095,675

[45] Date of Patent: Mar. 17, 1992

[54] RECESSED, RAISED BUILDING PANEL

[76] Inventor: Salvatore Audia, 16627 Millar, Clinton Township, Mich. 48026

[21] Appl. No.: 482,175

[22] Filed: Feb. 20, 1990

[51] Int. Cl.[5] ..... E04B 3/70; E04C 2/26

[52] U.S. Cl. ..... 52/455; 52/309.9; 52/314; 52/716

[58] Field of Search ..... 52/311, 314, 455, 309.9, 52/312, 316, 456, 313, 716; 428/163, 167, 172, 541, 542.8

[56] References Cited

U.S. PATENT DOCUMENTS

| | | | |
|---|---|---|---|
| 1,934,792 | 11/1933 | Chaffee | 52/314 |
| 4,008,551 | 2/1977 | MacDonald et al. | 52/456 X |
| 4,083,160 | 4/1978 | MacDonald et al. | 52/456 X |
| 4,097,100 | 6/1978 | Sauder . | |
| 4,327,788 | 5/1982 | Turner . | |
| 4,518,446 | 5/1985 | Drennon | 52/455 X |
| 4,702,054 | 10/1987 | Turner . | |
| 4,704,834 | 11/1987 | Turner . | |
| 4,706,431 | 11/1987 | Corvese . | |
| 4,716,705 | 1/1988 | Formanek et al. . | |
| 4,756,350 | 7/1988 | Turner . | |
| 4,896,471 | 1/1990 | Turner . | |

*Primary Examiner*—Michael Safavi
*Attorney, Agent, or Firm*—Basile and Hanlon

[57] ABSTRACT

A building panel, such as a door, wall panel, etc., is formed of a solid, planar body, having first and second opposed, major surfaces. A groove of a predetermined shape, such as a square or rectangle, is formed in at least one of the first and second major surfaces of the body. The groove has an open end and extends partially into the body. A decorative molding having a base portion complementary to the shape of the groove is fixedly mounted in the groove. In one embodiment, the molding includes opposed, outwardly extending flanges which are located to overlay the edges of the major surfaces of the body when the molding is mounted in the groove on the body. The groove and the molding may be mounted on both of the major surfaces of the body and in multiple numbers or patterns on one or both of the major surfaces of the body.

9 Claims, 2 Drawing Sheets

RECESSED, RAISED BUILDING PANEL

BACKGROUND OF THE INVENTION

Field of the Invention

The present invention relates, in general, to building structures and, specifically, to building panels and, even more specifically, to doors.

Building panels, such as doors, are employed in homes and building to close openings in the walls of such structures. Other building panels, such as cabinet doors, are used to close hollow cabinets. Further, recessed panels are mounted on interior building walls for decoration. Such building panels are typically formed of a solid body, such as a single piece of wood or interconnected wood panels and door and cross rails. Each panel typically has smooth, planar major surfaces.

The decorative aspects of such building panels are enhanced by mounting decorative trim moldings in various patterns, such as squares, rectangles, etc., on one or both major surfaces of the door. Such moldings are well known and are in the form of elongated, thin strips of wood which have been cut or formed into a decorative shape including curves, rounded edges, flats, etc. Such moldings are mounted on the major surfaces of doors via suitable fasteners, such as nails, screws, etc.

Another decorative building panel construction utilizes planar, solid, vertical door rails and interconnecting, horizontal cross rails which extend between and are joined to the top, intermediate and bottom portions of the door rails. The interconnected door and cross rails form one or more openings in which a recessed decorative panel of any desired shape and design is mounted. This door construction, however, is costly due to the number of individual pieces and the extensive time and labor involved in manufacturing each decorative panel.

Thus, it would be desirable to provide a building panel in which a decorative appearance is easily and inexpensively achieved. It will also be desirable to provide a building panel, such as a door, in which a decorative appearance is easily provided on any type of door construction and on either or both major surfaces of the door. Finally, it would be desirable to provide a building panel which has a high quality, decorative appearance; but which is inexpensive in cost and requires minimal labor and time to manufacture.

SUMMARY OF THE INVENTION

The present invention is a recessed, raised building panel, such as a door, wall panel, etc. The building panel or door comprisees a solid body having first and second major, opposed surfaces bounded by peripheral edges. A groove is formed in at least one of the first and second major surfaces of the body and extends inward from an open outer end a predetermined distance into the thickness of the body. A decorative molding is fixedly mounted in the groove.

In a preferred embodiment, the body is preferably formed of a single piece, solid material, such as wood, wood composite covered by a veneer material layer, or a rigid foam covered by outer veneer material layers.

The groove formed in the body may have any shape and design. By way of example only, the groove in the building panel of the present invention has a polygonal peripheral shape, such as triangular, square, rectangular, etc., formed by interconnected side portions having a closed periphery.

The decorative molding may also take any form. In a preferred embodiment, the molding is symmetrical about its longitudinal axis or centerline and includes a pair of outwardly extending flanges extending from opposed side walls. The flanges are positioned between the top and bottom surfaces of the molding so as to overlay the surface of the body when the molding is fixedly mounted in the groove.

The building panel of the present invention may be employed in any type of door application, such as a single door hinged at one side, as well as in bi-fold or swinging doors, or in any wall panel application in which a decorative panel in mounted on a wall. In the bi-fold or swinging door configurations, the groove in each of the bodies may be formed such that at least one end terminates in the side edge of the adjacently disposed bodies. In this manner, when the bodies are extended into their planar, a side-by-side position, the grooves and moldings mounted in each body form a continuous pattern across both bodies.

The building panel of the present invention provides a decorative appearance to a building panel, such as a door, which is inexpensively achieved with minimal labor and time. Mounting the moldings in a groove formed on the body of the building panel simplifies the mounting of the moldings since the moldings may be merely adhesively joined in position in the groove. This eliminates the need for numerous fasteners, such as screws and nails, as well as additional steps needed to cover such fasteners after the molding is mounted on the panel.

Further, the building panel of the present invention may be employed in any type of solid panel construction, whether the door is constructed of wood, wood composite or rigid foam. Further, the building panel may be employed in a single door configuration as well as in double bi-fold or swinging doors.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
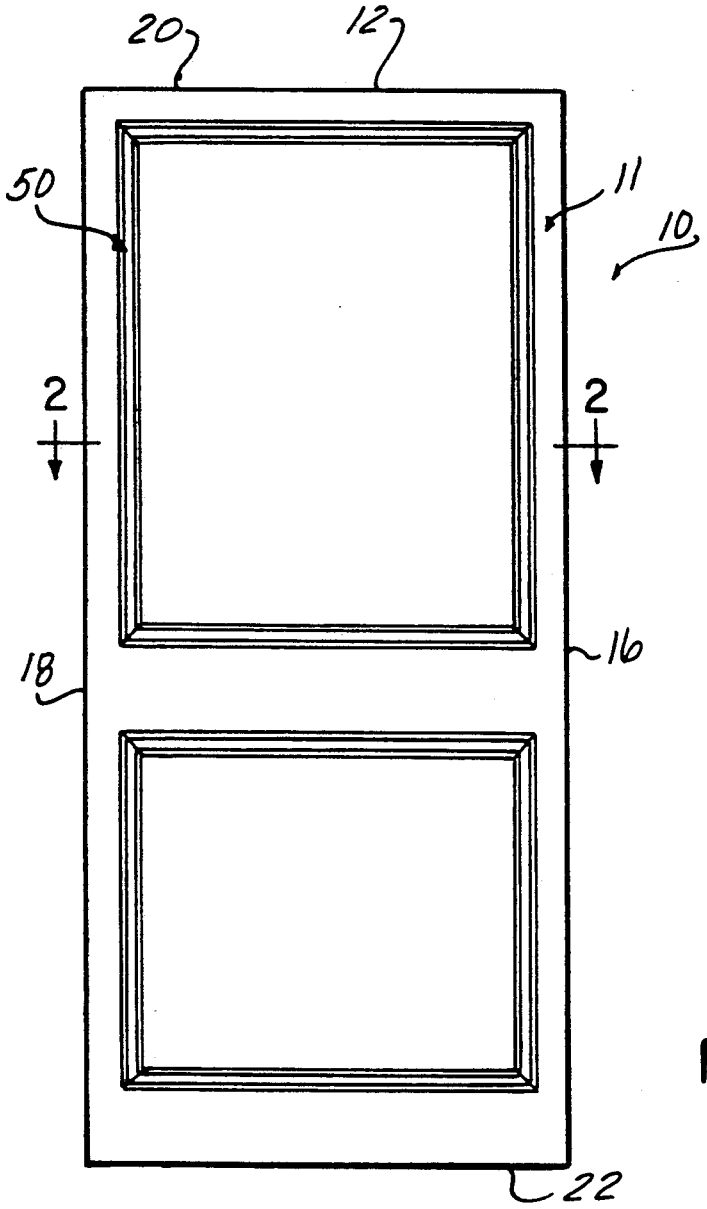
FIG. 1 is a front elevational view of one embodiment of the building panel of the present invention.

Throughout the following description and drawing, an identical reference number is used to refer to the same component shown in multiple figures of the drawing.

Referring now to the drawing, and to FIG. 1 in particular, there is illustrated a building panel, such as a door 10. FIG. 1 illustrates the building panel or door 10 as being constructed as a single piece member. The door 10, as is well known, may be hinged at either the left or right side, in the orientation shown in FIG. 1, to a surrounding wall closure or frame. Although a door 10 is illustrated in the drawing and described in detail below, it will be understood that this is by way of example only. The building panel of the present invention can also be employed on cabinet doors as well as decorative, recessed wall panels mounted on interior walls of buildings.

In a preferred embodiment, the door 10 includes a body 11 formed of a planar, solid material. Preferably, a single piece construction is employed for the body 11. Alternately, a plurality of individual pieces may be joined together into a solid, integrally connected body.

The body 11 includes first and second opposed, major surfaces 12 and 14. The first and second major surfaces 12 and 14 are bounded by peripheral edges including opposed side edges 16 and 18, a top edge 20 and a bottom edge 22.

Figure 2:
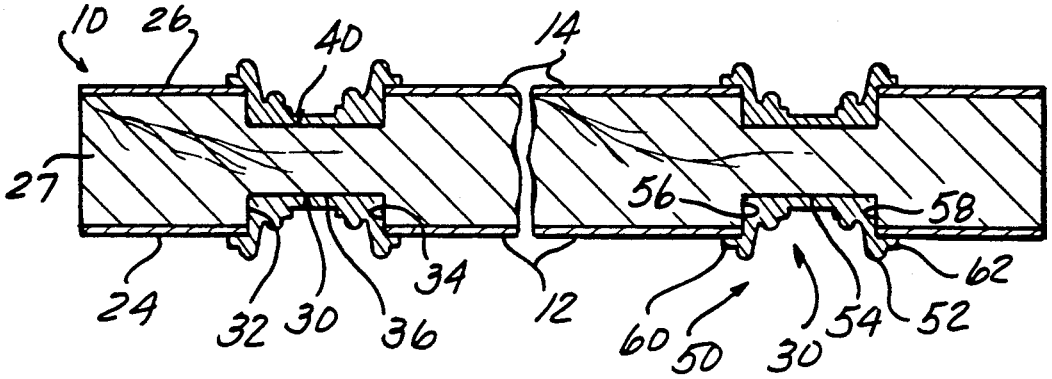
FIG. 2 is a cross sectional view generally taken along line 2-2 FIG. 1.

The body 11 may be formed of any suitable, solid material. Preferably, wood is employed to form the body 11. Alternately, a wood composite, such as particle board, lumber core, veneer core, etc., may be employed. In this embodiment, thin material layers 24 and 26 are mounted on the exterior surfaces of a wood composite core 27, as shown in FIG. 2. The veneer material layers 24 and 26 are preferably formed of wood and provide a decorative appearance for the wood composite core 27.

Also, the body 11 may be formed of a rigid, foam material, such as that sold under the registered trademark "Styrofoam." When the rigid foam core is used, the veneer layers 24 and 26 are also mounted on the major outer surfaces 12 and 14.

As shown in FIGS. 1 and 2, a groove denoted by reference number 30 is formed in one of the first and second major surfaces 12 and 14 of the body 11. In a broad embodiment, the groove 30 is formed in one of the surfaces, such as first major surface 12. The groove 30 may have any form or shape. The groove 30 also includes an open end facing outward from the first major surface 12. In a preferred embodiment, the groove 30 is formed with side walls 32 and 34 and a bottom 36 which is perpendicular to and extends between the side walls 32 and 34. The groove 30 extends a predetermined distance into the body 11 from the first major surface 12.

The groove 30 may have any shape to provide a decorative appearance on the building panel 10. In a preferred embodiment, the groove 30 has a polygonal peripheral shape as shown in FIG. 1. The polygonal shape is formed by interconnected side portions defining a closed, peripheral boundary. Preferably, the groove 30 has a polygonal shape, such as triangular, square, rectangular, hexagonal, etc. Each side portion is contiguous to an adjacent side portion to form a continuous groove or slot around the entire periphery of the groove 30.

Although one groove 30 may be formed on one of the major surfaces, such as major surface 12 of the body 11, it is also possible that additional grooves, such as shown in FIG. 1, may be disposed on the same major surface 12. Alternately, one or more grooves may be formed on each of the first and second major surfaces 12 and 14 of the body 11, as shown in FIG. 2. In this embodiment, a first groove 30 is formed on the first major surface 12 of the body 11 and a second groove 40 is formed on the second major surface 14. The grooves 30 and 40 may be identical or different and may be positioned at different locations on the first and second major surfaces 12 and 14 or directly opposed and aligned, as shown in FIG. 2.

A decorative molding, denoted by reference number 50, is fixedly mounted in the groove 30. The decorative molding 50 may take any form and shape. However, the decorative molding 50 must have an interconnecting portion so as to fit snugly within the groove 30.

Figure 3:
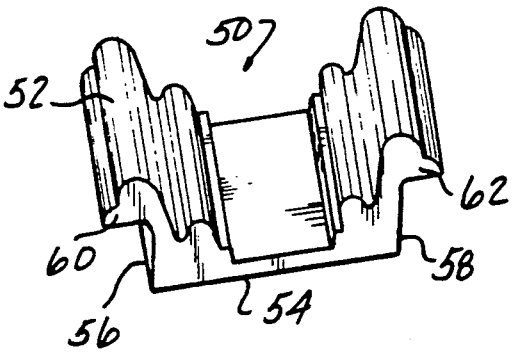
FIG. 3 is a perspective view of one embodiment of a decorative molding employed in the building panel shown in FIG. 1.

The decorative molding 50 is conventionally known as a trim molding and is formed of a thin elongated strip of a suitable material, such as wood. Such moldings are provided with various reliefs, rounded edges, curved or arcuate surfaces, flats and ridges, as shown in the examples depicted in FIGS. 3 and 4. As shown in FIGS. 2 and 3, the decorative molding 50 has a top surface 52 which forms the decorative exterior of the molding 50, and a base formed of a bottom surface 54 and opposed side walls 56 and 58. The base formed of the bottom surface 54 and the side walls 56 and 58 has a configuration complementary to the shape of the groove 30 so as to snugly fit within the groove 30 in substantial registry with the side walls 32 and 34 and the bottom 36 of the groove 30.

The top or exterior surface 52 of the molding 50 may have any desired shape. In a preferred embodiment, however, the molding 50 includes first and second outwardly extending flanges 60 and 62 which are integrally formed with the remainder of the molding 50 and are positioned between the top and bottom surfaces 52 and 54 of the molding 50. The flanges 60 and 62 extend outward from the side walls 56 and 58, respectively. When the molding 50 is mounted in the groove 30 on the body 11, the flanges 60 and 62 overlay the adjacent edges of the first major surface 12 of the body 11 so as to provide an enhanced decorative appearance to the building panel 10.

It should also be noted that the molding 60 shown in FIGS. 2 and 3 is completely symmetrical about a longitudinally or lengthwise extending axis. This is, the various rounded surfaces, arcuate surfaces, flats and ridges adjacent the side wall 56 shown in the orientation of FIG. 3 are identical to such surfaces formed on the right half adjacent the side wall 58 of the molding 50.

The decorative molding 50 is fixedly mounted in the groove 30 by any suitable means. Preferably, an adhesive, such as a wood campatible adhesive, is employed to mount the molding 50 in the groove 30. Pressure, such as by a press, may be applied to the molding 50 and the body 10 to secure the attachment of the molding 50 to the body 10.

Alternately, suitable fasteners, such as nails, screws, etc., may be employed to mount the molding 50 in the groove 30. It should be noted that multiple pieces of molding 50 are mounted in the groove pattern shown in FIG. 1. Four of such molding pieces 50 are mounted along each of the side portions of the groove 30 in the embodiment shown in FIG. 1. The abutting edges of each molding piece 50 may be cut or mitered, as shown in FIG. 1, to provide a smooth fit therebetween, as is well known.

Figure 4:
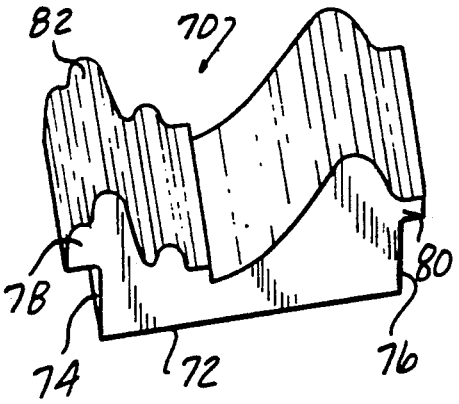
FIG. 4 is a perspective view of another embodiment of a decorative molding which may be employed in the building panel of the present invention.

An additional embodiment of a decorative molding which may be used in the building panel 10 of the present invention is shown in FIG. 4 and depicted by reference number 70. This molding 70 also has a base 72 and opposed side walls 74 and 76 which extend perpendicularly therefrom. The base or bottom 72 and the side walls 74 and 76 have a shape complementary to the shape of the groove 30 so as to snugly mount the molding 70 in the groove 30. The top exposed surfaces 82 of the molding 70 has a different configuration from the molding 50 shown in FIG. 3 and is illustrated only for clarity in describing alternate molding configurations which may be used with the present invention. However, it should be noted that the molding 70 has first and second, opposed flanges 78 and 80 which extend outward from the side walls 74 and 76, respectively. The flanges 78 and 80 overlay the first major surface of the building panel 10 when the molding 70 is mounted in the groove 30 on the building panel 10.

Figure 5:
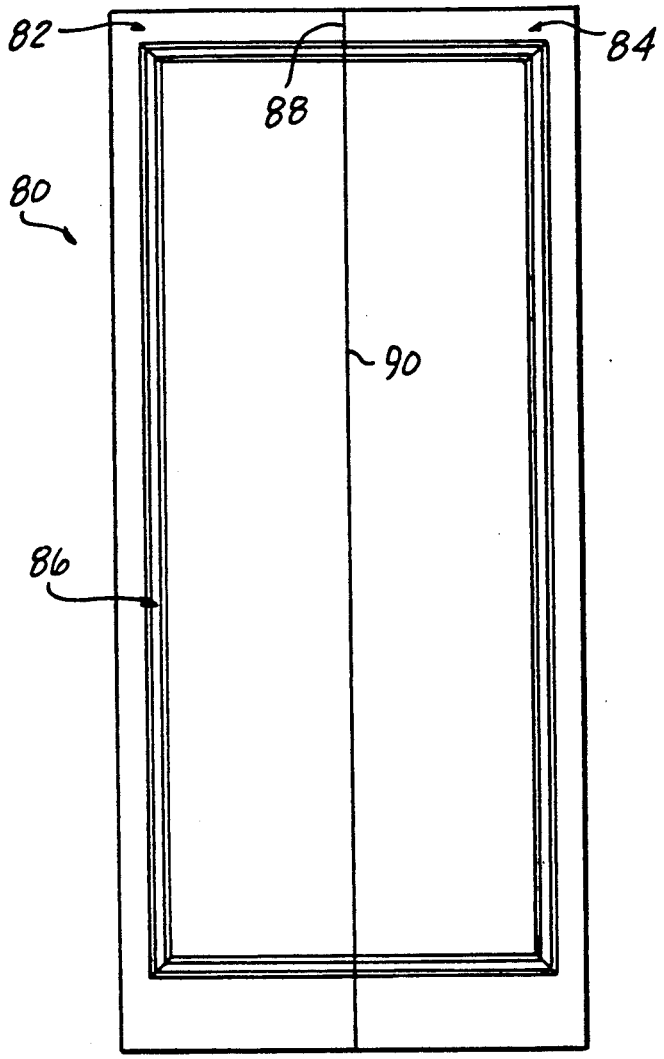
FIG. 5 is a front elevational view of another embodiment of the building panel of the present invention.

Referring now to FIG. 5, another embodiment of a building panel 80 constructed in accordance with the teachings of the present invention is illustrated. The building panel 80 is in the form of a bi-fold or swinging door formed of two side-by-side substantially identical panels 82 and 84. Each of the panels 82 and 84 is constructed identical to the building panel 10 described above. Thus, each of the panels 82 and 84, such as panel 82, has a solid structure with a groove formed on one or both of the major surfaces thereof. A decorative molding 86 is mounted in the groove in each of the building panels 82 and 84. However, in this embodiment, the groove in the building panels 82 and 84 terminates along the facing, opposed side edges 88 and 90 of the building panels 82 and 84. In this manner, when the building panels 82 and 84 are disposed in their extended, planar, side-by-side position, as shown in FIG. 5, the ends of the grooves in each of the panels 82 and 84 align so as to form a continuous, single pattern across both panels 82 and 84. It should be noted that this description of a single pattern on both panels 82 and 84 is by way of example only and multiple individual patterns, separare from each other, may be formed on each of the panels 82 and 84, on one or both of the major surfaces of the panels 82 and 84.

In summary, there has been disclosed a unique building panel having a decorative molding fixedly mounted in a groove formed on one or both of the major surfaces thereof. The decorative molding provides a decorative appearance to the panel. However, the mounting of the molding in the groove formed on the building panel is inexpensive in cost, labor and manufacturing time.

The groove and the molding may be formed in a variety of patterns and shapes on the building panel. Further, the molding and groove may be employed with any type of building panel construction, such as a single piece panel, wood composite core covered by veneer layers, or rigid foam core covered by veneer material layers.

What is claimed is:

1. A building panel comprising:

a solid body having first and second major, opposed surfaces bounded by peripheral edges;

a groove formed in one of the first and second major surfaces of the body, the groove extending from one of the first and second major surfaces partially through the body between the first and second major surfaces thereof; and a decorative molding fixedly mounted in the groove, the molding having a bottom portion mountable in the groove, a thickness greater than the depth of the groove and a pair of spaced top ends extending outward above one of the first and second major surfaces of the body when the molding is mounted in the groove, the molding being symmetrical about a longitudinal axis and including a central recess extending below the pair of top ends, first and second opposed flanges formed intermediate the top ends and the bottom portion of the molding and extending outward from opposed sides of the molding to overlay portions of one of the first and second major surfaces of the body adjacent the groove.

2. The building panel of claim 1 wherein:

groove has a polygonal peripheral shape formed of side portions arranged in a closed periphery; and the molding comprises a plurality of segments mounted in the groove, with the edges of the segments abutting each other.

3. The building panel of claim 1 wherein:

the body is formed of a single material piece.

4. The building panel of claim 1 wherein:

at least one groove is formed on each of the first and second major surfaces of the body.

5. The building panel of claim 4 wherein:

the grooves on each of the first and second major surfaces of the body are identical and directly opposed to each other.

6. The building panel of claim 1 wherein the body is formed of wood.

7. The building panel of claim 6 further including:

a thin veneer material layer mounted on one of the first and second major surfaces of the body, the groove being formed through the veneer material layer.

8. The building panel of claim 1 wherein:

the body is formed of a rigid foam material; and further including:

a thin veneer material layer mounted on both of the first and second major surfaces of the body, the groove extending through one of the veneer material layers into the body.

9. The building panel of claim 1 wherein the body is a door.

* * * * *